US006824030B1

(12) United States Patent
Dolan

(10) Patent No.: US 6,824,030 B1
(45) Date of Patent: Nov. 30, 2004

(54) POSTURE PACK

(76) Inventor: Doris B. Dolan, P.O. Box 530940, Harlingen, TX (US) 78553-0940

( * ) Notice: Subject to any disclaimer, the term of this patent is extended or adjusted under 35 U.S.C. 154(b) by 0 days.

(21) Appl. No.: 09/567,392

(22) Filed: May 9, 2000

(51) Int. Cl.[7] ..... A45F 3/04
(52) U.S. Cl. ..... 224/638; 224/640; 224/645
(58) Field of Search ..... 224/627, 629, 224/637, 638, 640, 645, 623, 660

(56) References Cited

U.S. PATENT DOCUMENTS

| | | | | | |
|---|---|---|---|---|---|
| 125,188 | A | * | 4/1872 | Foy | 224/638 X |
| 268,932 | A | * | 12/1882 | Poirier | 224/638 X |
| 4,307,826 | A | * | 12/1981 | Stewart | 224/253 |
| 4,673,117 | A | * | 6/1987 | Calton | 224/627 X |
| 4,676,418 | A | * | 6/1987 | Lowe | 224/215 |
| 4,716,947 | A | * | 1/1988 | Haddock | 150/106 |
| 5,114,059 | A | * | 5/1992 | Thatcher | 224/209 |
| 5,240,159 | A | * | 8/1993 | Gregory | 224/209 |
| 5,255,833 | A | * | 10/1993 | McAllister | 224/202 |
| 5,487,498 | A | | 1/1996 | Gleason | |
| 5,529,230 | A | | 6/1996 | Smith | |
| 5,564,612 | A | * | 10/1996 | Gregory | 224/633 |
| 5,586,700 | A | * | 12/1996 | Fitzner et al. | 224/219 |
| 5,676,293 | A | * | 10/1997 | Farris | 224/576 |
| 5,725,139 | A | * | 3/1998 | Smith | 224/637 |
| 5,950,896 | A | * | 9/1999 | Theodore | 224/647 |
| D421,523 | S | * | 3/2000 | Freyer | D3/217 |
| 6,070,776 | A | * | 6/2000 | Furnary et al. | 224/627 |

OTHER PUBLICATIONS

M. R. Franks, Letter to the Editor: School–bag ploy transparent, Baton Rouge Advocate, Aug. 24, 1994, at 6B.*

* cited by examiner

*Primary Examiner*—Stephen K. Cronin
(74) *Attorney, Agent, or Firm*—Fattibene & Fattibene; Paul A. Fattibene; Arthur T. Fattibene

(57) ABSTRACT

A back pack assembly comprised of a back pack front shoulder straps and a lateral back strap designed to concentrate the weight bearing forces of the back pack assembly on the thoracic spinal column and thereby promote normal posture of the person.

6 Claims, 4 Drawing Sheets

POSTURE PACK

1. Field of the Invention

This invention relates to load carrying packs that are strapped to the back of a person. Further the invention relates to a structure for the load carrying pack that is intended to protect the posture of the spinal column from deformity.

2. State of the Prior Art

There are numerous designs for packs or sacks that are strapped to the body of a person for purposes of carrying personal items while leaving the arms free of the items carried. There are so called back packs, fanny packs, and other types of sack like packs that are strapped to the body for purposes of carrying items for the person wearing the pack.

In the past and prior to the advent of the present invention the load bearing packs are essentially designed to distribute the load being carried so as to accentuate the normal curvature of the spinal column. This leads to spinal column deformity either of a temporary nature or permanent deformity of the spinal column.

The spinal column consists of twenty four vertebra which are constructed of bone. Between each bony vertebra is a so called cartilaginous disk called the spinal disk. These spinal disks are subject to compression forces and to torsional forces during the day and usually compensate for these forces. The spinal column has three major curves called the cervical curve, the thoracic curve, and the lumbar curve. There are six cervical vertebra comprising the cervical curve of the spine. The thoracic curve is comprised of twelve thoracic vertebra and the lumbar curve is comprised of six lumbar vertebra. The normal cervical curve and the normal lumbar curve of the spine are concave inwards. The normal thoracic curve is convex inwards.

While the spinal column can withstand considerable compression pressure or force it is vulnerable to torsional forces or forces that are horizontal to the spinal column. Accentuation of the normal curvature of the spinal column can result in deformity. For example the condition known as kyphosis is an exaggeration of the normal thoracic curvature of the spine. It can be caused by poor posture or excessive force on the thoracic spine. Lordosis is another abnormal spinal column condition which is an exaggeration of the lumbar curvature of the spine. It can be caused by increased by increased weight in the region of the abdomen or by forces of a horizontal nature on the spinal column.

All spinal column deformities are exaggerations of the normal curvature of the spine or are lateral bending of the spinal column. This leads the conclusion that forces antagonistic to the normal curvature of the spinal column result in compensation by the intervertebral disks and do not cause spinal column deformity. On the other hand it is reasonable to conclude that forces on the spinal column that accentuate the normal curvature of the spine can lead to temporary or even permanent deformity of the spine.

Young persons attending school must of necessity carry relatively large loads of books and other school materials. For example a young person attending school weighing 75 pounds could be forced to carry 25 pounds of books and other school materials. Additionally the young student may be required to ascend and descend stairs throughout the day causing additional forces and pressures on the skeleton of the young person. In young persons who are growing in size the skeletal system of the body of such a person is in a stage of development and is vulnerable to forces and pressures on the spinal column and other bones of the body.

In the past there have been numerous so called packs for carrying items for the personal and leaving the arms and hands free but these designs tend to accentuate and thereby distort the normal curvature of the spinal column.

Thatcher in U.S. Pat. No. 5,114,059 discloses a frameless back pack that is claimed to be universally adjustable. This back pack is designed to concentrate the load in the back pack to the hips and lumbar spinal column of the user. Since the load would be concentrated at least in part over the lumbar spinal column this invention would promote deformity of the spinal column.

For example Gleason in U.S. Pat. No. 5,487,498 discloses a so called fanny pack or back pack which is worn over the back of a person and designed to concentrate the weight of the pack at the region of the lumbar curvature of the spine. Clearly this concentration of weight is likely to result in accentuation of the normal lumbar curvature of the spine and the abnormal condition known as lordosis.

Another lumbar pack is disclosed in U.S. Pat. No. 5,529,230 by Smith. Again this lumbar pack would exert a force that accentuates the normal lumbar curvature of the spine leading to either temporary or permanent deformity of the spinal column.

The desirability of concentration of the forces of a carrying pack on the thoracic region of the spine is recognized by Theodore in U.S. Pat. No. 5,950,896. This patent discloses a front pack structure with a lumbar strap that tends to exert pressure on the thoracic area of the spine and thereby promote good posture. This invention, however, teaches away from the back pack of the present invention.

SUMMARY OF THE INVENTION

There has been a long felt need for a carrying pack that promotes good posture especially in young school children. Accordingly it is one objective of the present invention to disclose a back pack that exerts its carrying load at the thoracic spine of the person. This force is exerted against the normal thoracic spinal curvature which tends to promote good posture by not accentuating spinal curvature. It is the accentuated spinal curvature that results in deformity of the spine.

Another object of the present invention is to disclose a transparent carrying structure that permits visual inspection of the contents of the pack. This is desirable in schools due to the possibility of the student carrying harmful or dangerous things in the pack.

The objectives of the present invention are accomplished by using straps on the back pack that distribute the forces of the load carried in the pack to the thoracic area of the spinal column.

DETAILED DESCRIPTION OF THE INVENTION

Figure 1:
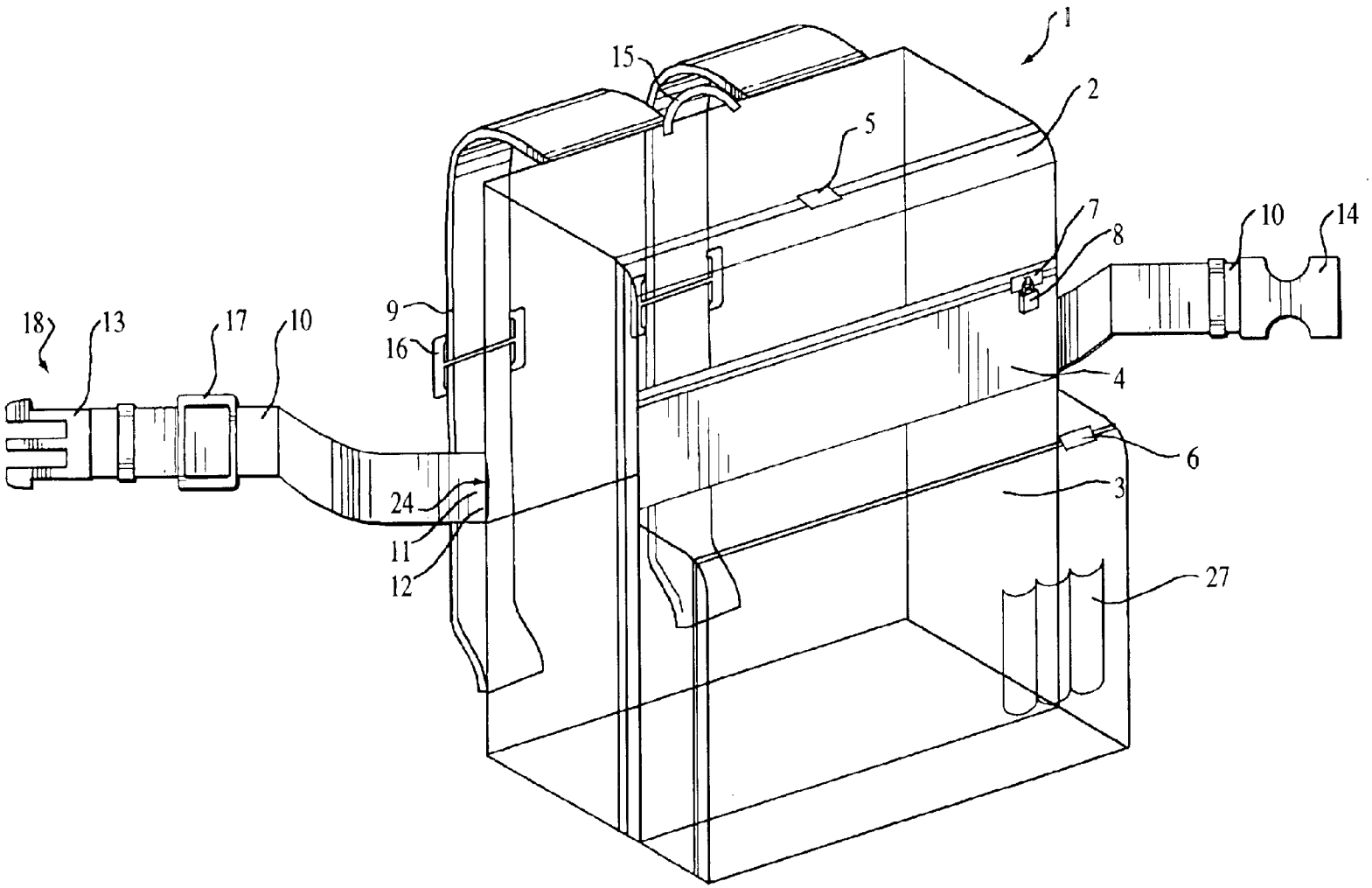
FIG. 1 is a prospective view of the posture pack.

FIG. 1 illustrates the entire posture pack comprised of a back pack 1 and straps. This back pack 1 can be made of any suitable material such as nylon or vinyl plastic. In one preferred embodiment of the invention the pack 1 is made of clear plastic material. This permits visual inspection of the contents of the pack which is desirable for packs of this nature being used by school children. This visual inspection tends to eliminate the carrying of harmful or even dangerous materials by the student at school.

In another preferred embodiment of the invention the posture pack is comprised of the back pack 1 and straps. The back pack 1 is shown with a plurality of compartments. The main compartment 2 is opened and closed with a zipper fastener 5 but could be opened and closed with a front flap assembly not shown in the drawing, or any other type of fastener. The auxiliary compartment 3 is also shown as opened and closed with a zipper fastener 6 but could be fastened with a front flap assembly or any other type of fastener. The main compartment 2 could be used for large objects such as books while the auxiliary compartment 3 could be used for carrying lunch material or smaller material. Thre are recesses 27 which are suitable for holding writing instruments such as pens and pencils. Attached to the back pack 1 is a hanging loop 15 which a student could use to hang up the pack on hangers which are often supplied for this purpose in school rooms.

There is a pouch 4 which is a wallet like compartment to the posture pack 1. The pouch 4 is preferably made of material such as canvas that is not transparent or translucent as is the preferred embodiment of the main compartments. There is a fastener 7 for the pouch 4 preferably a zipper fastener. A small lock 8 can be attached to the pouch. The pouch 4 is suitable for carrying money, identification cards, credit cards, and other similar things.

To hold the back pack 1 in place shoulder straps 9 and a load carrying back strap 10 are used. The shoulder straps 9 have adjustable buckles 16. These shoulder straps 9 extend from the top of the pack 1 to near the bottom of the pack 1 so as to concentrate the forces of the pack 1 on the thoracic spinal region.

The load carrying back strap 10 is shown as passing through the inside of the back pack 1 through openings 24. The back strap 10 is affixed to the backpack 1 with a velcro fastener 11 on the back strap 10 and another velcro fastener 12 on the back pack 1. However, any other kind of fastener could be used for this purpose. The load carrying back strap 10 has adjusting buckles 17 and a quick release buckle 18.

Figure 2:
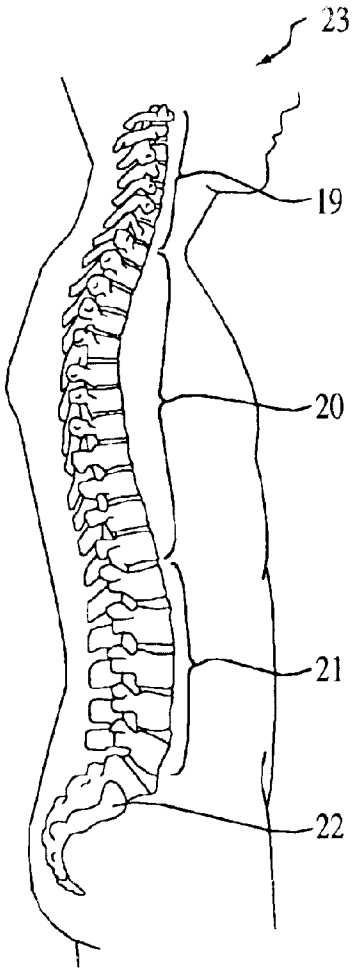
FIG. 2 is a lateral view of the normal curvature of the spinal column.

FIG. 2 shows the normal curves of the spinal column 23 which is comprised of 24 vertebra. The cervical spine 19 is concave inwards in curvature. The thoracic spine 20 is convex in curvature and the lumbar curve 21 of the spine is again concave inwards. The sacrum 22 is located at the lower end of the spinal column.

Figure 3:
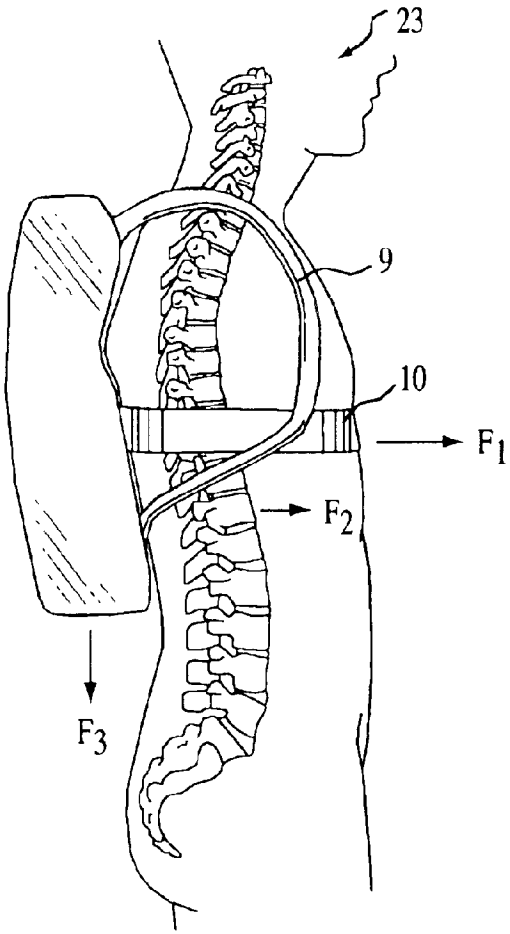
FIG. 3 is a force diagram showing how the weight of the pack and its contents concentrates force on the thoracic area of the spine.

FIG. 3 is a force diagram showing the back pack 1 as it is pressed against the spinal column 23 with the shoulder straps 9 and the load carrying back strap 10. This shows how the shoulder straps 9 are anchored to the back pack 1 above the bottom of the back pack 1 in order to more fully concentrate the forces of the load in the back pack 1 to the thoracic area of the spine.

The force $F_1$ is caused by the load carrying back strap 10 and is directly over the optimum area of the thoracic spine. The force $F_2$ is again concentrated at the lower area of the thoracic spine by the shoulder straps 9. The force $F_3$ represents the weight of the contents of the back pack 1 all of which is transmitted to the thoracic spine by the front shoulder straps 9 and the load carrying back strap 10.

Figure 4:
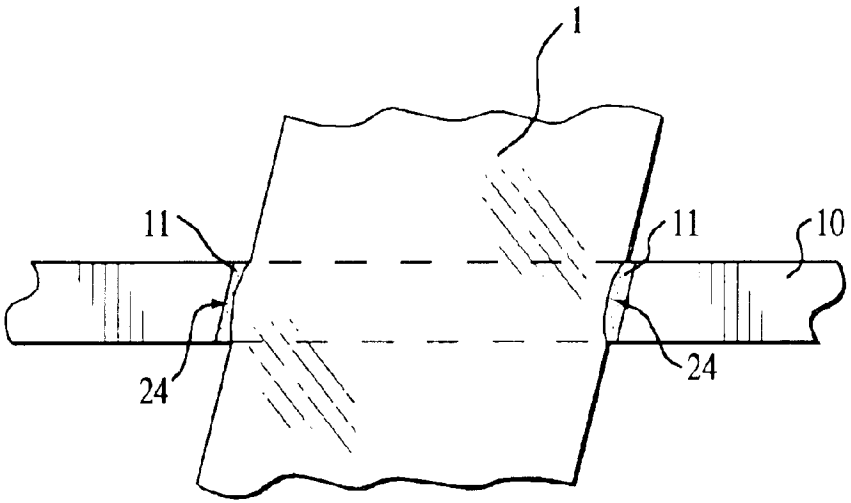
FIG. 4 is a detailed view of the load carrying back strap of the posture pack is affixed to the backpack itself.

FIG. 4 is a detailed view of the openings in the back pack 1 which permit the back strap 10 to be fastened to the back pack 1 at the inside of the back pack 1 through openings 24 in the back pack 1. Also shown are velcro fasteners 12 attached to the back pack 1 which anchor the back strap 10 in place.

Figure 5:
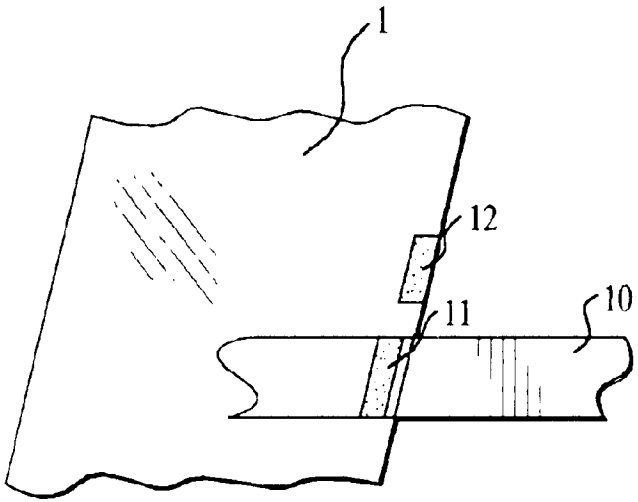
FIG. 5 is a detailed view of how the load carrying back strap is anchored in place on the backpack.

FIG. 5 is a detailed view of the velcro fastener attached to the back pack 1 and the velcro fastener 11 attached to the back strap 6.

Figure 6:
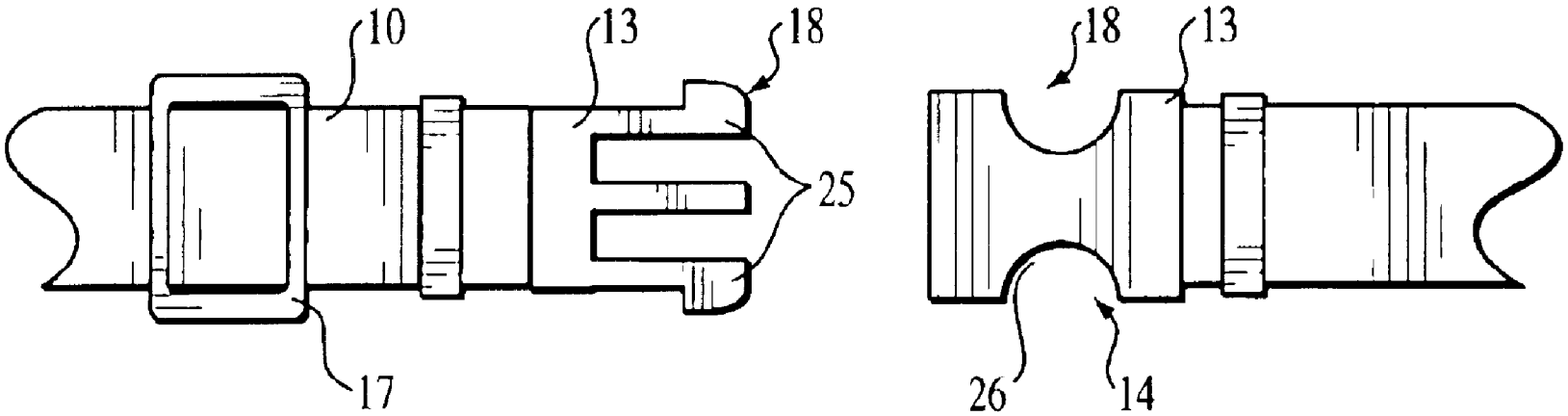
FIG. 6 is a detailed view of the quick release buckle on the load carrying back strap.

FIG. 6 is a detailed view of the quick release buckle 18 for the front of the back strap 10. The quick release buckle 18 has a male element 13 and a female element 14. There is also an adjusting buckle 17. The male element 13 has prongs 25 which anchor the back strap 10 through openings 26 in the female element 14. By pressing on the prongs 25 while in the grooves 26 the buckle is quickly released.

The above description of the invention is for purposes of illustration only and not for purposes of limitation. The limitations of this invention are expressed in the following claims.

What is claimed is:

1. A load carrying back pack for exerting a carrying load at a thoracic area of a spine of a person comprising:

a pack having a weight and a top and a bottom;

front shoulder straps extending from the top of said pack to near the bottom of said pack; and a single transverse load carrying back strap attached to said pack substantially midway between the top and the bottom of said pack in a position directly over the thoracic area, substantially all of the weight of said pack transmitted to the thoracic area by said front shoulder straps and said single transverse load carrying strap, whereby forces of the weight of said pack are distributed to the thoracic area of the spine promoting good posture by not accentuating spinal curvature.

2. A load carrying back pack for exerting a carrying load at a thoracic area of a spine of a person as in claim 1 wherein:

said pack is transparent, whereby visual inspection of the contents of said pack is permitted.

3. A book carrying posture correcting back pack for exerting a carrying load at a thoracic area of a spine of a young person comprising:

a pack carrying books having a weight and a top and a bottom;

a pair of adjustable front shoulder straps extending from the top of said pack to near the bottom of said pack, whereby forces of the weight of the pack are concentrated at the thoracic area of the spine of the young person; and a single transverse load carrying back strap attached to said pack substantially midway between the top and the bottom of said pack in a position directly over the thoracic area, substantially all of the weight of said pack transmitted to the thoracic area by said front shoulder straps and said single transverse load carrying strap, whereby forces of the weight of said pack are distributed to the thoracic area of the spine promoting good posture by not accentuating spinal curvature.

4. A book carrying posture correcting back pack for exerting a carrying load at a thoracic area of a spine of a young person as in claim 3 wherein:

said pack is transparent, whereby visual inspection of the contents of said pack is permitted.

5. A load carrying back pack that fits over the thoracic spinal column of the back of a person comprising:

a main material holding compartment having a top and a bottom;

additional material holding compartments;

front shoulder straps that are anchored to the main material holding compartment at the top of the main material holding compartment and anchored higher than the bottom of the main material holding compartment so as to concentrate the load of the back pack to the thoracic spinal column;

a single transverse load carrying strap attached to said main material holding compartment substantially midway between the top of the main material holding compartment and the bottom of said main material holding compartment and that is located over the thoracic spinal column of the person;

buckles attached to said front shoulder straps and said single transverse load carrying strap for adjustment of the length of each said front shoulder straps and said single transverse load carrying strap;

a quick release buckle attached to the single transverse load carrying strap;

fasteners that permit opening and closing of each material holding compartment of the back pack; and wherein substantially all of the weight of the back pack is transmitted to the thoracic area of the person's spine by the front shoulder straps and the single transverse load carrying back strap, whereby the load of the back pack is concentrated over the thoracic spinal column of the user promoting good posture by not accentuating spinal curvature.

6. A method of wearing a load carrying back pack comprising the steps of:

placing a pack having shoulder straps over a person's shoulders, the pack positioned over a thoracic area of the person's spine;

positioning a single transverse load carrying back strap directly over the thoracic area of the person's spin and attached to the pack substantially midway between a top and bottom of the pack; and adjusting the shoulder straps and the single transverse load carrying back strap so that substantially all of the weight of the pack is transmitted the thoracic area of the person's spine by the front shoulder straps and the single transverse load carrying back strap, whereby forces of the weight of said pack are distributed to the thoracic area of the spine promoting good posture by not accentuating spinal curvature.

* * * * *